United States Patent [19]

Bendell

[11] 4,429,258

[45] Jan. 31, 1984

[54] ELECTRON BEAM ALIGNMENT IN TUBE/COIL ASSEMBLIES

[75] Inventor: Sidney L. Bendell, Riverton, N.J.

[73] Assignee: RCA Corporation, New York, N.Y.

[21] Appl. No.: 253,013

[22] Filed: Apr. 10, 1981

[51] Int. Cl.[3] ..... H01J 29/56

[52] U.S. Cl. ..... 315/382; 315/31 TV

[58] Field of Search ..... 315/382, 370, 31 TV, 315/5.35, 31 R, 14, 14 XR, 368, 13 C, 364, 393; 328/228; 313/414, 442, 433, 425; 335/210, 213; 250/396 R

[56] References Cited

U.S. PATENT DOCUMENTS

| | | | |
|---|---|---|---|
| 2,443,025 | 6/1948 | De Tar | 313/425 |
| 2,539,492 | 1/1951 | Smyth | 313/442 X |
| 2,886,727 | 5/1959 | Haine | 313/433 |
| 3,145,321 | 8/1964 | Sadashige | 315/30 |
| 4,027,219 | 5/1977 | van Alphen et al. | 315/368 |

*Primary Examiner*—Maynard R. Wilbur
*Assistant Examiner*—M. R. Gordon
*Attorney, Agent, or Firm*—E. M. Whitacre; W. H. Meise

[57] ABSTRACT

In a tube/coil assembly of the type wherein the tube includes a gun for directing a beam of electrons to a target electrode and both focus and alignment coils are included within the assembly, the alignment coil is electrically energized with some portion of the current flowing through the focus coil to eliminate the need for an independent alignment coil current source.

1 Claim, 7 Drawing Figures

ELECTRON BEAM ALIGNMENT IN TUBE/COIL ASSEMBLIES

BACKGROUND OF THE INVENTION

This invention relates to television camera tube/coil assemblies in which the focus coil is coupled in a common circuit with an alignment coil to utilize the same current supply.

Tube/coil assemblies are often utilized for imaging in the electronic arts. For example, television cameras may use imaging tubes such as vidicon tubes and the like. Such tubes generally include a cathode for emitting electrons towards a target electrode upon which a visual image is focused by optical elements. The signal output is taken from the target electrode as a result of the interaction of the electron beam with the light responsive target. In order to have a television video signal derived from the target which properly represents the image, various distortions must be avoided and the resolution must be high. High resolution requires that the electron beam be focused on the target electrode. Such focusing is provided by a focus coil which is generally a solenoid winding extending over a substantial portion of the tube. Deflection windings are also included in such assemblies in order to deflect the focused electron beam over the surface of the target so as to scan a rectangular raster representing the image.

Among the constraints required in order to have the video signal properly represent the image being scanned is the requirement that the electron beam be orthogonal to the plane of the target during those times when it is directed on the center of the raster. If the beam direction at the center of the raster is not orthogonal to the surface, various distortions of the video can occur. Such distortions include lag, poor resolution, degraded picture geometry and signal anomalies referred to as "waterfall" or "stern wave" in which the plane of the image appears to be on a water surface that has ripples passing thereacross, such as waves on the surface of the ocean.

The electron beam originates from a cathode and passes through a grid having a small hole which is a defining aperture. That portion of the electron beam passing through the defining aperture may be travelling along a path which is skewed with respect to the longitudinal axis of the tube. The skew angle is the misalignment angle $\phi$ as illustrated in FIG. 1. It is known to correct the misalignment angle to substantially zero degrees by the use of a magnetic field generator in the region between the defining aperture and the beam-entrance end of the focus coil. It is known to use permanent magnets to generate a magnetic field in this region for alignment of the electron beam to reduce the misalignment angle $\phi$ to zero. The advantage of a permanent magnet alignment method is that it requires no electrical power to maintain the field. However, the field generated by permanent magnets is difficult to control. Since the magnitude of the required magnetic field will vary from tube to tube, it is necessary to either control the magnitude of a single permanent magnet or to provide two permanent magnets and use one to partially offset the field of the other so as to control the resulting magnitude of the magnetic field. Where a small resulting magnitude is required, the magnetic field magnitudes of the two permanent magnets must be identical. Such identical magnets are difficult to manufacture. Also, in those cases where a great deal of cancellation is required in order to achieve a small resulting field magnitude, the slightest relative motion between the two permanent magnets can create major changes in the resulting field magnitude. Consequently, such arrangements may be easy to adjust but are difficult to maintain in adjustment. Another disadvantage arising from the use of permanent magnets is that magnetic singularities in the magnetic structures can cause irregularities in the field derived therewith. Furthermore, for the permanent magnets to be physically positioned relative to each other in providing the appropriate resulting field and then the magnet combination to be positioned in correcting the alignment of the electron beam, required ready access to the magnets. This ready access tends to complicate the shielding by which the entire image tube is shielded from external magnetic fields. Thus, the use of permanent magnets to correct for beam misalignment angle presents many disadvantages.

In order to avoid the disadvantages of permanent magnets, it is known to use electromagnets. Such electromagnets are ordinarily operated as orthogonal pairs and a current through each is controlled both in magnitude and in polarity as as to develop a resultant field of the proper direction and amplitude to correct the beam misalignment angle. However, this requires at least a regulated current source and a control element for each winding. Consequently, a three-tube color camera might require as many as 6 individual coil windings. Since the current in the various coil windings are in general dissimilar, even as to polarity, no possibility exists for simultaneous control of those windings. Therefore, individual current sources and control elements would be necessary and consequently, substantial power dissipation and electrically complexity result. These are extremely disadvantageous, especially for those cameras which are used in portable applications where power must be provided by batteries. The complexity of the circuits and the numerous adjustments undesirably add weight, while the current load reduces the maximum time of operation. Obviously then, an electromagnet arrangement of reduced power consumption and having simplified circuitry would be extremely desirable for electric beam alignment.

SUMMARY OF THE INVENTION

In a tube/coil assembly of the type wherein the tube includes an electron gun for directing the beam of electrons towards a target electrode and wherein both focus and alignment coils are included within the assembly, an improved arrangement in which the alignment coil is electrically energized by a portion of the current flowing through the focus coil to thereby eliminate the need for an independent current source to supply the alignment coil.

DESCRIPTION OF THE INVENTION

Figure 1:
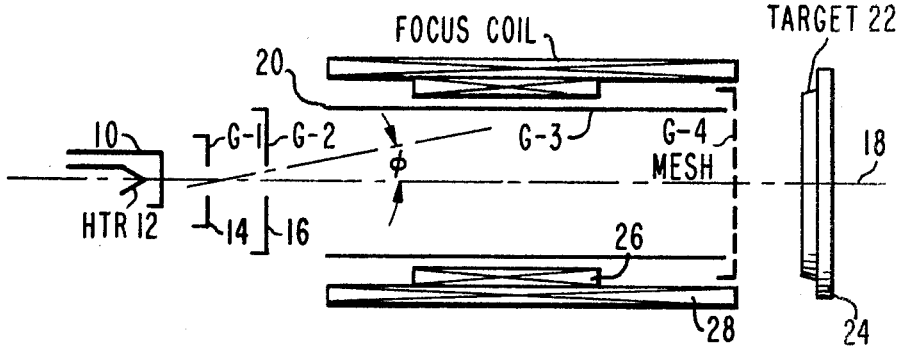
PRIOR ART Fig. 1
FIG. 1 is a cross-section of a camera tube/coil assembly according to the prior art.

FIG. 1 represents a cross-section of a vidicon tube together with some ancillary coils. The glass tube envelope and certain electrostatic shields have been deleted from FIG. 1 in order to enhance clarity. In FIG. 1, a cathode 10 is heated by a heater 12 and produces electrons which pass through beam defining apertures in a G-1 grid 14 and a G-2 grid 16 arranged along the tube axis 18. The defining aperture in grid 16 allows the electron beam to pass into the space within a cylindrical G-3 focus electrode 20. The electron beam passes through cylindrical electrode 20 and impinges upon a target electrode 22. A transparent faceplate electrode 24 is connected to the outer surface of target 22 and an image is optically focused through electrode 24 onto target 22 from a source (not shown). The video signal output is taken from conductive electrode 24.

Surrounding cylindrical electrode 20 are arranged deflection coils illustrated as 26. A solenoidal focus coil 28 also surrounds electrode 20. The deflection coils 26 are energized as known with normal saw tooth currents which cause the vertical and horizontal deflection of the electron beam passing through electrode 20 so as to scan a rectangular raster upon the target 22. The focus coil 28 is energized with a carefully selected magnitude of a constant direct current in order to focus the electron beam and counteract the beam spreading caused by repulsion of unrestrained electrons within the beam.

Figure 2:
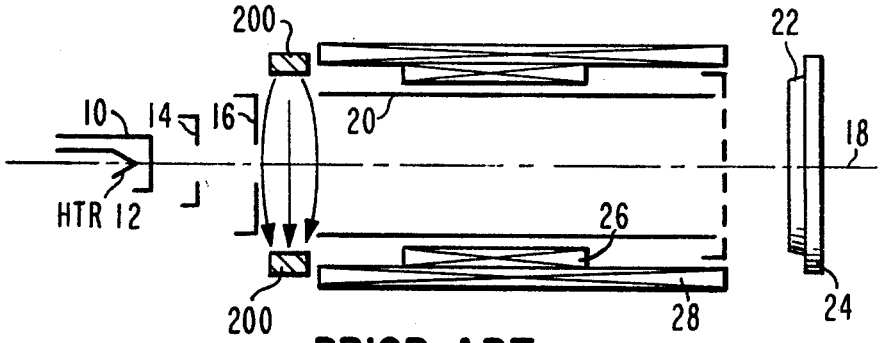
PRIOR ART Fig. 2
FIG. 2 is similar to FIG. 1 and includes a magnetic beam alignment arrangement.

In FIG. 2, elements corresponding to those in FIG. 1 are designated by the same reference numbers. FIG. 2 also includes a magnetic structure designated as 200 for generating a magnetic field as illustrated by the arrows for correcting the direction of the beam issuing from the defining aperture in grid 16 so as to cause the path taken by the beam to be such that when it arrives at the center of the target 22 the path is orthogonal to the plane of the target. Naturally, the direction of the magnetic field as illustrated by the arrows may be changed by rotating structure 200 about the axis of the tube so as to provide a correction appropriate to the direction of the misalignment angle.

Figure 3:
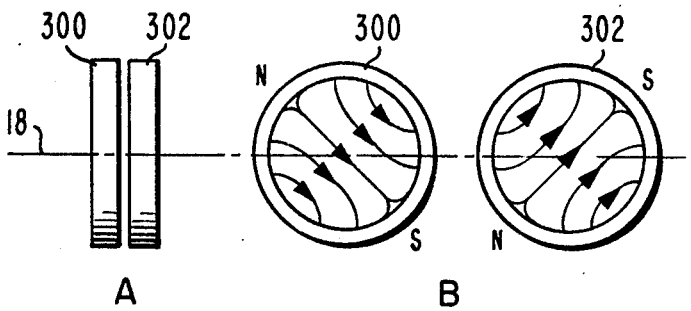
PRIOR ART Fig. 3
FIG. 3 illustrates a permanent-magnet beam alignment assembly.

FIG. 3 illustrates a permanent-magnet arrangement which may be used for generating a magnetic field which is variable both in magnitude and in direction. in FIG. 3A, the toroidal permanent magnets are seen in side view. FIG. 3B illustrates separately the magnets illustrated in FIG. 3A in a view taken along the direction of axis 18. As can be seen in FIG. 3B, a first magnet 300 comprises a toroidal ferrite structure polarized with north and south magnet poles. As a result of this polarization, a magnetic field is established within the structure of magnet 300 as illustrated by the arrows. A similar magnetic field is set up in magnet 302. Because of the proximity of magnets 300 and 302, the magnetic fields interact and can be arranged either to add in obtaining a large resultant field or to cancel in obtaining a small resultant field. In addition to control of the resultant field magnitude by vectorial addition, the angle made by the resultant magnetic field can be controlled by rotating the two magnets together as a unit about axis 18. Thus, when an arrangement as illustrated in FIG. 3 is used in place of structure 200 in FIG. 2, both the magnitude and direction of the magnetic field may be controlled so long as the magnets have identical characteristics. However, as mentioned previously, the magnetic fields cannot in general be made identical, and such permanent magnets are subject to other objections.

Figure 4:
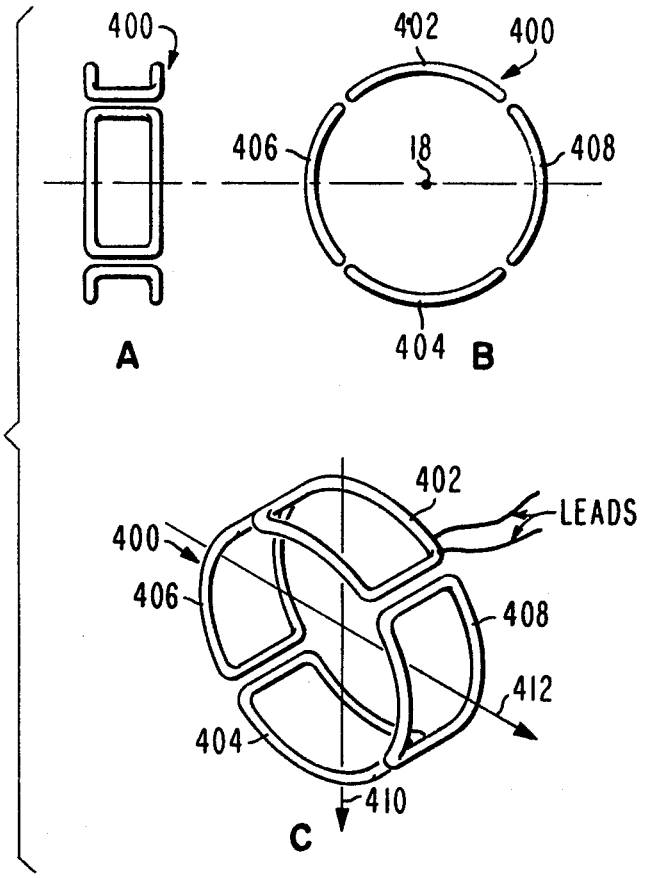
FIG. 4 illustrates an electromagnetic beam alignment assembly.

FIG. 4 illustrates another magnetic field generator which may be used in place of alignment magnetic field generator 200 of FIG. 2. In FIG. 4A, an electromagnetic field generator coil or winding assembly 400 is illustrated in side view. FIG. 4B illustrates coil 400 in a view taken along axis 18. In FIG. 4B it can be seen that assembly 400 is made up of four individual coils 402, 404, 406, 408, each subtending a quadrant. This can be most clearly understood by reference to FIG. 4C, which is a perspective view of the alignment winding 400. As can be seen in FIG. 4C, the coil 400 is made up of four individual coils, each of which defines a window or opening. Each of the four coils includes two leads, although only the leads on coil 402 are shown for the sake of simplicity. Coils 402 and 404 are connected in series to form a first subassembly, while coils 406 and 408 are connected in series to form a second subassembly. When current is passed through either subassembly, the flux generated thereby is established through the windows of the individual coils in the direction indicated by the arrows 410 and 412, respectively. When an assembly such as 400 is mounted about the image tube as illustrated in FIG. 2, the coil subassemblies can be separately energized with current of magnitudes selected to make the magnitude and direction of the vectorial resultant of the fields equal to that desired.

Figure 5:
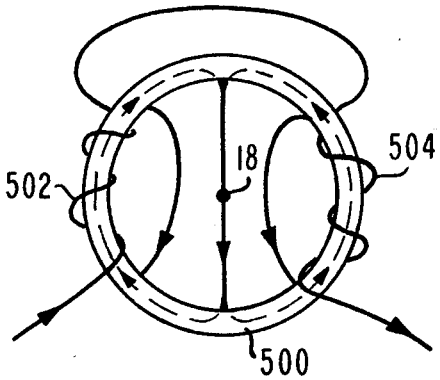
FIG. 5 illustrates an alignment coil for use with the invention.

FIG. 5 illustrates a magnetic field generator which can be used with the invention. In FIG. 5, a toroidal magnetic core 500 has wound thereabout a first and a second coil 502 and 504, respectively, which are coupled in series to form a winding. The polarity of the coupling is such that current flow establishes within the core a magnetic flux which is so directed that it opposes at the top and at the bottom of the core 500. As a result of this opposition, the flux "spills over" from the core and passes through the central aperture of the core in the direction shown by the arrows. If such a magnetic field generator is mounted about the image tube in the position of the structure 200 in FIG. 2, a magnetic field can be generated within the tube, the magnitude of which is controlled by the magnitude of the current flowing within windings 502 and 504 and by the number of turns of each of the windings 502 and 504. The direction of the magnetic field within the image tube can be controlled by physically rotating core 500 about axis 18.

Figure 6:
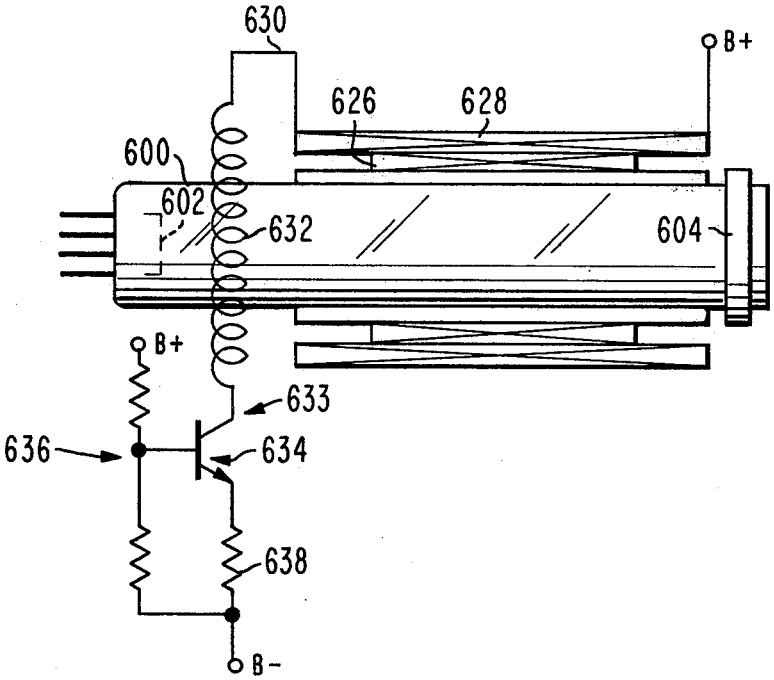
FIG. 6 illustrates a camera tube/coil assembly with an alignment coil electrically connected according to one preferred embodiment of the invention.

FIG. 6 illustrates an embodiment of the invention. In FIG. 6, an image tube 600 includes an electron gun assembly 602 for emitting a beam of electrons which is directed along a path towards a target 604. A focus coil 628 is arranged around both the deflection coil 626 and tube 600. One end of focus coil 628 is coupled to a source B+ of voltage. The other end of the winding of focus coil 628 is coupled by means of a conductor 630 to a magnetic beam alignment corrector illustrated schematically as a coil 632 which physically may resemble the arrangement of FIG. 5. The other end of winding 632 is coupled to a constant-current source designated generally as 633 which is embodied as a transistor 634, the base of which is coupled to a voltage divider 636 and the emitter of which is coupled through an emitter resistor 638 and to a second terminal B− of the source of energizing potential. Many other types of current sources can be used instead of the arrangement shown.

In FIG. 6, the alignment coil 632 and focus coil 628 are energized from the same current source 633 whereby the current in coil 632 is the same as that in coil 628 and therefore a separate current source to energize the alignment coil 632 is not required. The constant current level of the current source 633 is established as the level necessary for the coils 628 to focus the electron beam as desired in the operation of the tube 600. The number of windings in the alignment coil is selected in accordance with the magnitude of the magnetic flux required to be derived from the alignment coil 632. That is, the number of windings of 632 is established by the required ampere-turns with the current that is provided by current source 633. In determining the number of windings to be utilized in the alignment coil 632, a test is conducted prior to final assembly of the tube/coil assembly. In this test, the number of windings for the alignment coil 632 and the orientation of those windings about the longitudinal axis of the tube 600 are varied, while the coil 632 is energized at the known current level to be drawn from the current source by the alignment coil in the final application of the tube/coil assembly. When the electron beam landing at the center of the scan raster in the tube 600 is substantially orthogonal to target 604, the position of the alignment coil 632 and the number of ampere-turns required are noted and then these conditions are duplicated in the final tube/coil assembly with a coil wound to have the exact number of required turns or by selecting a coil having substantially the required number of turns from a convenient number of coils, each having a different number of turns in a range known to be sufficient for use as the alignment coil in the particular type of tube/coil assembly.

Figure 7:
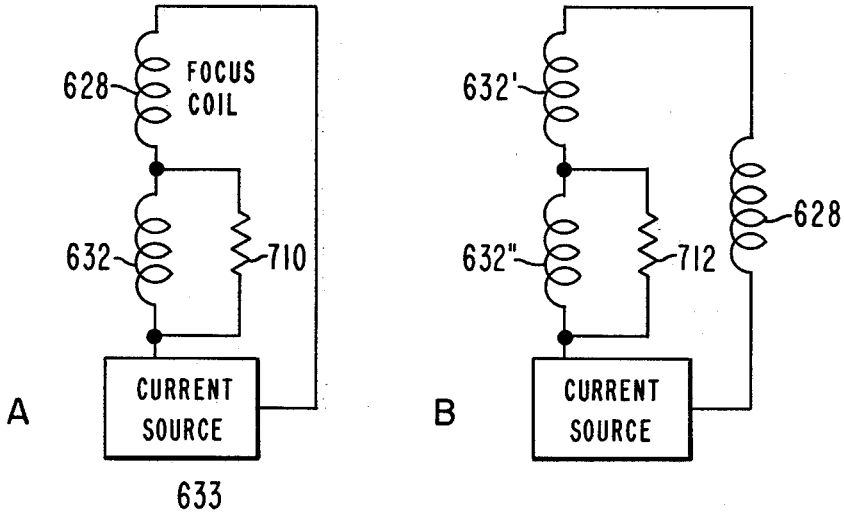
FIG. 7 illustrates other preferred embodiments of the invention.

Although the alignment coil 632 and focus coil 628 are shown to be connected in series through connection 630 in FIG. 6, it should be realized that the alignment coil 632 could be energized with only a portion of the current flowing through focus coil 628 as shown in FIG. 7. A resistor 710 is connected in parallel with the alignment coil 632 in FIG. 7A. Therefore, only a portion of the current flowing through focus coil 628 from the current source 633 is directed through the alignment coil 632. Of course, the resistance of both the alignment coil 632 and resistor 710 will vary with temperature and therefore, measures must be taken to assure that the ratio of current flowing in the alignment coil 632 and resistor 710 remains unchanged by temperature variation. However, this temperature compensation can be provided in many well known ways, such as by connecting a thermistor in series with the resistor 710. Furthermore, resistor 710 might be used to trim the ampere-turns to the correct value if the exact value cannot be achieved by controlling the number of turns with the given focus current. FIG. 7B illustrates a similar circuit arrangement for the embodiment of the invention wherein separate coils are utilized in the alignment coil 632 as shown in FIG. 4wherein the portions of the focus coil current to be utilized in each winding is determined by one or more shunting resistors 712 across either or both of the separate coils 632' and 632''. By adjusting the value of the shunting resistors in FIG. 7B the resulting flux of the alignment coil 632 is thereby determined and consequently in this arrangement, the alignment coil 632 would not have to be physically oriented about the longitudinal axis of the tube but would be electrically oriented due to the values of the shunting resistors.

What is claimed is:

1. An improved portable television camera arrangement adapted to be powered from a battery, comprising:

a camera tube including an electron gun assembly for emitting a beam of electrons directed along a path towards a photosensitive target, said beam as it leaves said electron gun assembly being unfocussed and directed at an arbitrary angle relative to a path orthogonal to the plane of said target, thereby causing image distortion;

a focus coil arranged about said path and having its axis coaxial with that of said camera tube and energized by a substantially constant focus current for causing said beam of electrons to be focused at said target;

and a beam alignment winding assembly arranged about said path and energized for magnetically influencing the path taken by said beam for causing said path to orthogonally intersect the plane of said target;

wherein the improvement lies in that said beam alignment winding assembly has a single magnetic axis which is physically oriented radially and electrically coupled with said focus coil in such a manner that said substantially constant focus current flows through said beam alignment winding assembly for energization thereof thereby eliminating the need for a separate beam alignment winding current source and also eliminating the need for a second magnetic axis associated with said beam alignment winding assembly.

* * * * *